US008152561B2

(12) United States Patent
Long

(10) Patent No.: US 8,152,561 B2
(45) **Date of Patent: *Apr. 10, 2012**

(54) CANTILEVERED MOUNTED BRACKET WITH A RECEPTACLE WITH MULTIPLE DEGREES OF MOTION

(75) Inventor: Wang Shyun Long, Singapore (SG)

(73) Assignee: Janam Technologies LLC

( * ) Notice: Subject to any disclaimer, the term of this patent is extended or adjusted under 35 U.S.C. 154(b) by 0 days.

This patent is subject to a terminal disclaimer.

(21) Appl. No.: 13/066,449

(22) Filed: Apr. 14, 2011

(65) Prior Publication Data

US 2011/0244718 A1 Oct. 6, 2011

Related U.S. Application Data

(63) Continuation of application No. 12/653,966, filed on Dec. 18, 2009, now Pat. No. 7,931,494.

(60) Provisional application No. 61/203,124, filed on Dec. 18, 2008.

(51) Int. Cl.
*H01R 13/66* (2006.01)

(52) U.S. Cl. ..... 439/527

(58) Field of Classification Search ..... 439/527–534, 439/542

See application file for complete search history.

(56) References Cited

U.S. PATENT DOCUMENTS

| | | | | |
|---|---|---|---|---|
| 4,640,984 | A * | 2/1987 | Kalbfeld | 174/135 |
| 6,858,921 | B2 * | 2/2005 | Kashiwagi et al. | 257/668 |
| 7,931,494 | B2 * | 4/2011 | Long | 439/527 |
| 2010/0291789 | A1 * | 11/2010 | Fujisaki | 439/357 |

* cited by examiner

*Primary Examiner* — Chandrika Prasad
(74) *Attorney, Agent, or Firm* — Thomas A. O'Rourke; Bodner & O'Rourke, LLP

(57) ABSTRACT

A holder is capable of providing flexible support for the connector of a flexible printed circuit board, and has particular applicability for battery recharging cradles for a mobile computing device or hand-held scanner. The holder comprises a receptacle having a rear wall and two side walls, along with protrusions to slidably retain the connector therein. The rear wall connects, using a radiused bend, to a connecting wall, which may form an acute angle relative to the rear wall, and which may neck down to improve rotational capability. The connecting wall transitions, using a radiused bend, to a transverse wall, and from its ends are two cantilever straps extending towards the receptacle, and thereby forming an acute angle relative to the connecting wall. An upward protruding boss on the end of each strap aids translational and rotational flexibility, where the holder is mounted to a surface using orifices in the bosses.

50 Claims, 13 Drawing Sheets

32
33

6

9
63
60
33

61
9
7
6
33

62
61
6
7
60

CANTILEVERED MOUNTED BRACKET WITH A RECEPTACLE WITH MULTIPLE DEGREES OF MOTION

CROSS REFERENCES TO RELATED APPLICATIONS

This application claims priority on U.S. Provisional Application Ser. No. 61/203,124 filed on Dec. 18, 2008, and is a continuation of U.S. application Ser. No. 12/653,966, filed Dec. 18, 2009 which issued as U.S. Pat. No. 7,931,494, the disclosures of which are incorporated herein by reference.

FIELD OF THE INVENTION

The present invention relates to improvements in electronic circuitry, and more particularly to apparatus which is capable of providing elastic support for connectors of flexible printed circuit boards.

BACKGROUND OF THE INVENTION

Flexible electronics, or Flex Circuits, involving the use of flexible printed circuit boards (FPC), represents an innovative technological improvement over conventional printed circuit boards (PCB). These flex circuits are manufactured by mounting electronic devices on flexible plastic substrates, which typically may be polyimide, or a poly(ether-ether-ketone) film (PEEK), or even screen printed silver circuits on polyester. An example of Flexible Printed Circuit Substrate is shown by U.S. Pat. No. 6,858,921 to Kashiwagi. The Kashiwagi FPC claims to feature a high accuracy connecting part that is intended to be attached to the connector, where the connecting part serves to alleviate connection failures "even if a pitch between two adjacent terminals is further reduced." Other flexible circuit boards are well known in the art.

Flexible printed circuits commonly have one or more connectors located upon each end, with the connector having a plurality of terminals, each of which may be electrically connected to the flexible printed circuit board. Often, a connector is configured to encompass the entire end of the FPC, which may not have the special connector of the type shown in Kashiwagi, and where the connector has an actuator that may be pressed down upon to provide electrical contact between the connector and the terminal. An example of such a connector is shown by U.S. Pat. No. 7,581,983 to Yuan. The Yuan connector further features the ability to receive in its entirety, two different flexible printed circuit substrates.

Although there are many advantages to circuits utilizing this construction and other types of flexible printed circuits, the adaptability of the board to conform to virtually any desired shape, and to be able to bend or flex even during its use, is most significant. These flex circuits are also advantageously used for electrical connections where either the board dimensions or space constraints are dominant factors. The applications may involve dynamic uses, such as for a folding cell phone, or be advantageously used in static applications particularly in tightly assembled electronic packages where electrical connections are required in three axes. Common uses are for notebook PCs, printers, digital camcorders, digital still cameras, camera modules, PDA units, mobile phones, LCD units, CD-ROM drives, DVD-ROM drives, MiniDisc players, and other compact equipment. Flex circuits may also be used to replace conventional wire harnesses that have typically been used in the aerospace industry for aircraft, rockets, and satellites.

In certain applications, mounting of the mating connectors is necessary, so it is common to have an FPC connector fixed to a cradle, but clearances and lead-in on the cradle may introduce forces in the connector during docking of a terminal into the cradle. Also, the user may mishandle the terminal when it is in the cradle, causing severe stress on the connector.

This invention serves to solve this problem by housing the connector on a specially adapted holder, which accommodates rotation and translation incurred at extreme positions.

OBJECTS OF THE INVENTION

It is an object of the invention to provide an elastic means of supporting a connector attached to flexible printed circuit board.

It is another object of the invention to provide a bracket arrangement for connectors of flexible printed circuits that supplements the flexible character of such devices.

It is a further object of the invention to provide an elastic support means for flexible printed circuit connectors that accommodates connector stresses due to misalignment from tolerance build-up eliminating clearances and causing stresses.

It is another object of the invention to provide an elastic support means for flexible printed circuit connectors that accommodates mishandling by a user.

It is also an object of the invention to provide an elastic support means for flexible printed circuit connectors that accommodates translation of the connector.

It is another object of the invention to provide an elastic support means for flexible printed circuit connectors that accommodates rotation of the connector.

SUMMARY OF THE INVENTION

Many electronic devices today advantageously utilize flexible printed circuits. However, flexible printed circuits ordinarily incorporate connectors on the ends, and in certain applications, mounting of the mating connectors is necessary, so it is common to have an FPC connector fixed to a cradle. However, for some cradles clearances and lead-in on the cradle may introduce forces in the connector during docking of a terminal into the cradle. Also, the user may mishandle the terminal when it is in the cradle, causing severe stress on the connector.

This invention serves to solve this problem by housing the connector on a specially adapted holder, which reduces connector stresses by accommodating rotation and translation incurred even for extreme positions.

The holder may accommodate multiple degrees of motion, while occupying a compact envelope. The connector of the flexible printed circuit is housed in a receptacle of the holder. The receptacle is configured to have a rear wall and two side walls. The connector may be housed therein using a number of different means. The side walls may have protrusions to retain the connector therein, by snapping the connector into position. Such an arrangement may be deleterious for the connector, therefore the protrusions may be slidably received by the connector, with it being retained by a cover. The side walls of the receptacle may further comprise mounting flanges, each having one or more orifices, which may be used in combination with a fastener to mount the cover.

Flexible mounting is accomplished by the remainder of the holder. The rear wall of the holder extends for a certain length and connects, using a radiused bend, to a connecting wall, which may form an acute angle relative to the rear wall, and which may neck down to improve rotational capability. The connecting wall transitions, in one embodiment, using a radiused bend, to a transverse wall, and from its ends are two cantilever straps extending towards the receptacle, and thereby forming an acute angle relative to the connecting wall. A pair of bends in each strap forms a joggle, and an upward protruding boss on the end of each strap aids translational and rotational flexibility, where the holder is mounted to a surface using orifices in the bosses.

DETAILED DESCRIPTION OF THE INVENTION

Figure 1:
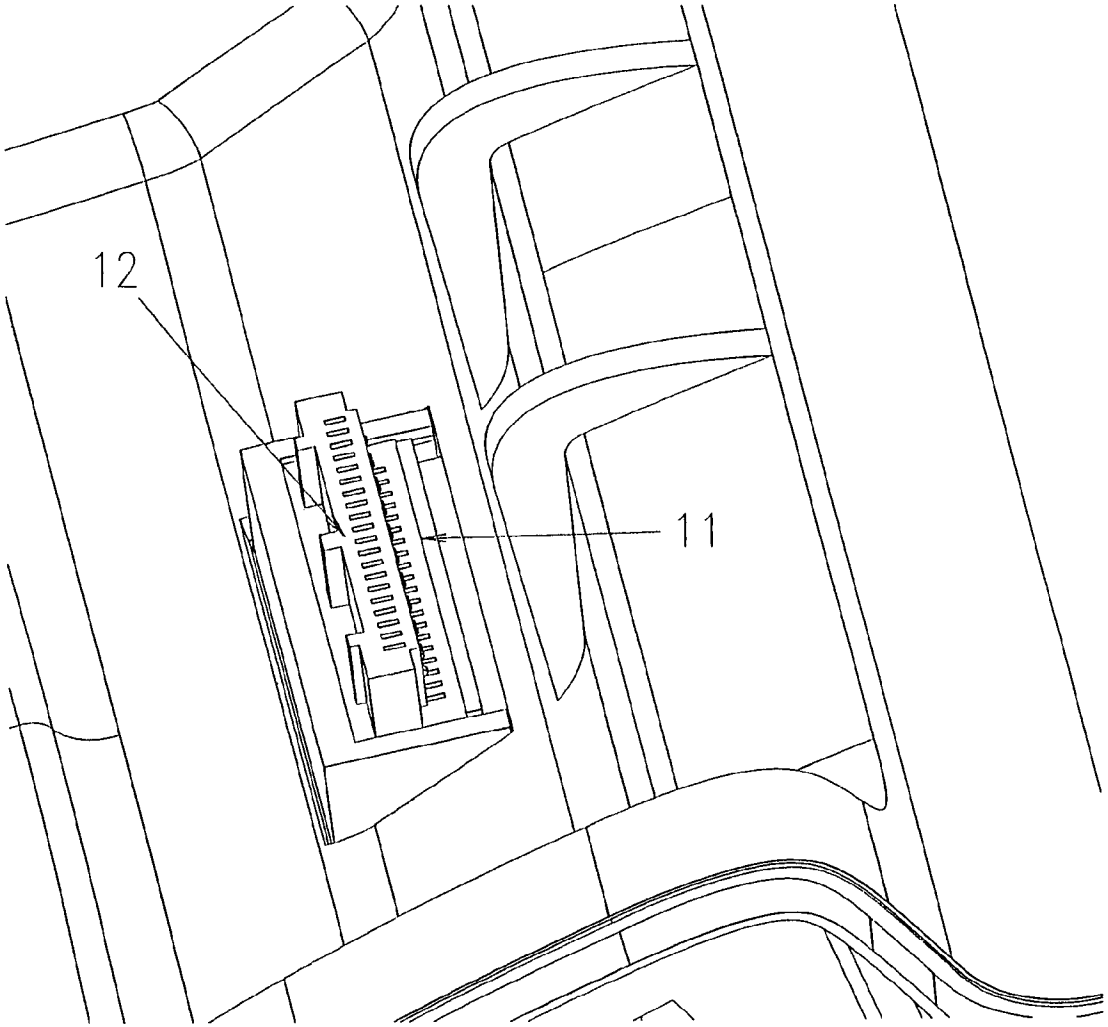
FIG. 1 is a perspective view showing hard mounting of a connector, which undergoes undesired deflection, with both the undeflected and deflected positions being shown.

FIG. 1 shows a perspective view of an example installation 10 with conventional hard mounting of an undeflected connector 11, and when loads are applied to the undeflected connector 11, it undergoes undesired deflection and results in the stressed connector 12. The stress experience by connector 12 may result in the disconnection of certain terminals within the connector, and improper functioning of the unit.

Figure 2:
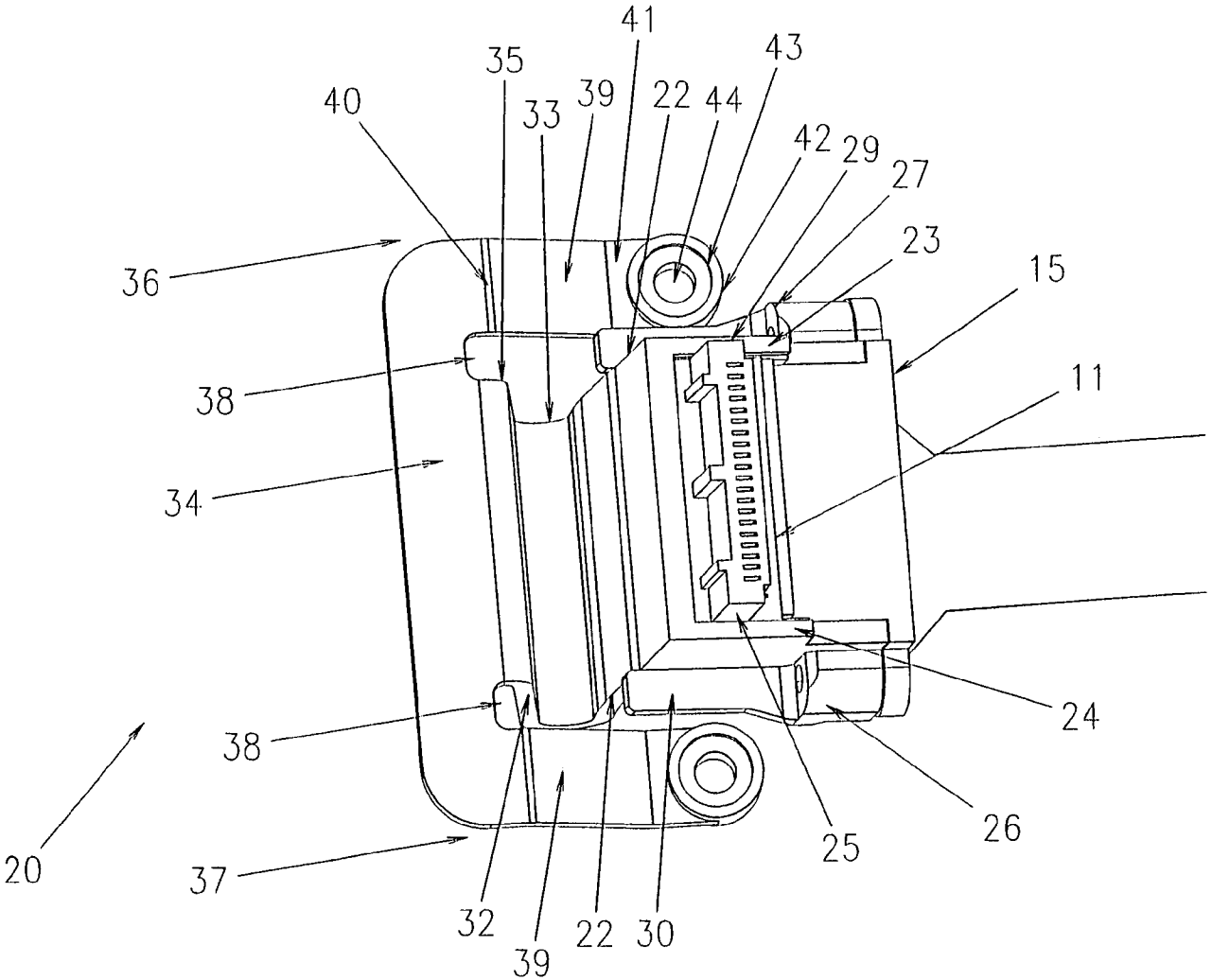
FIG. 2 is a first embodiment of the current invention shown supporting a connector that is mounted on a flexible printed circuit.
Figure 12:
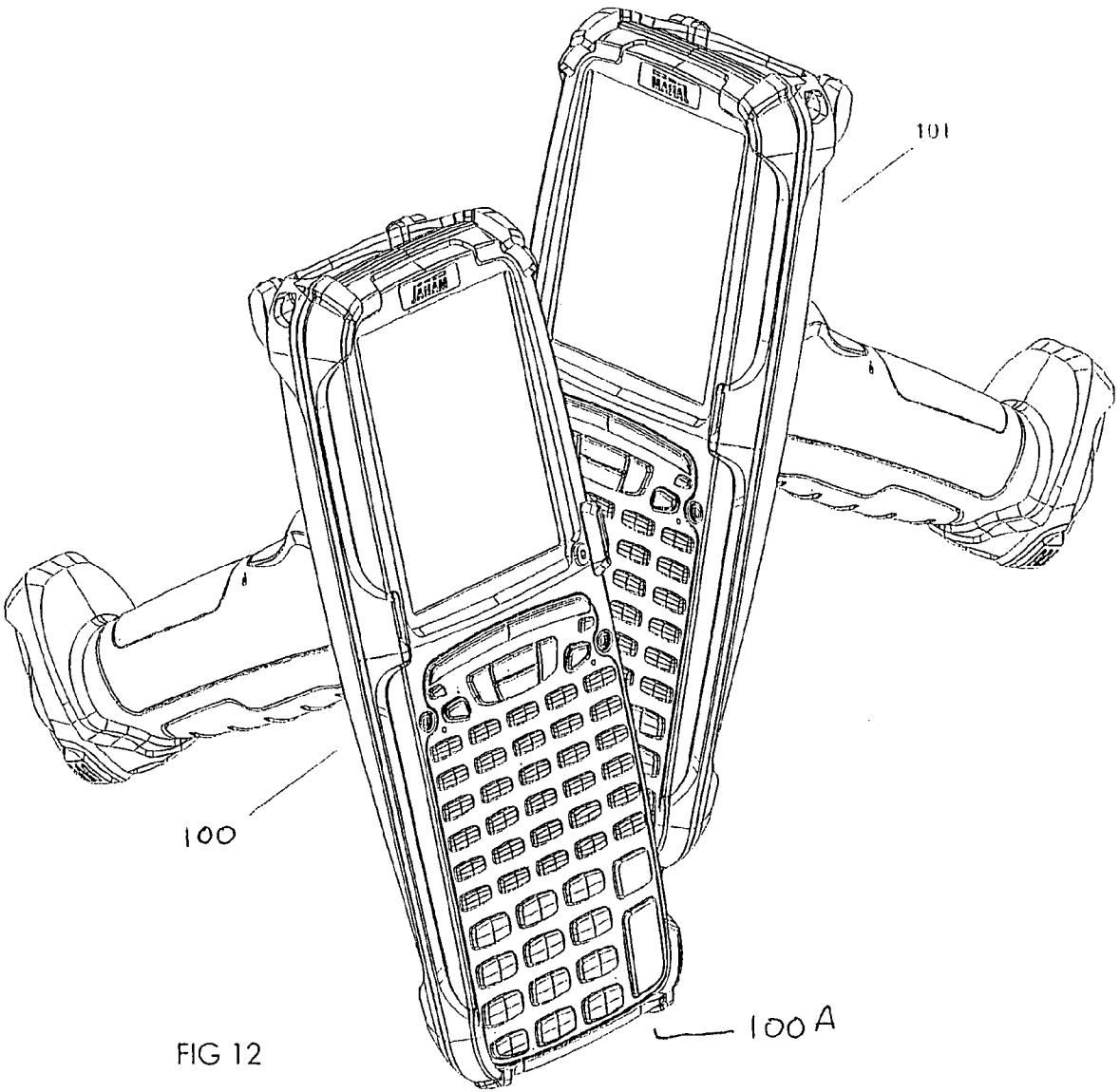
FIG. 12 is a mobile computing device which may be inserted into a cradle having a electrical connector flexibly supported by the holder of the current invention.
Figure 13:
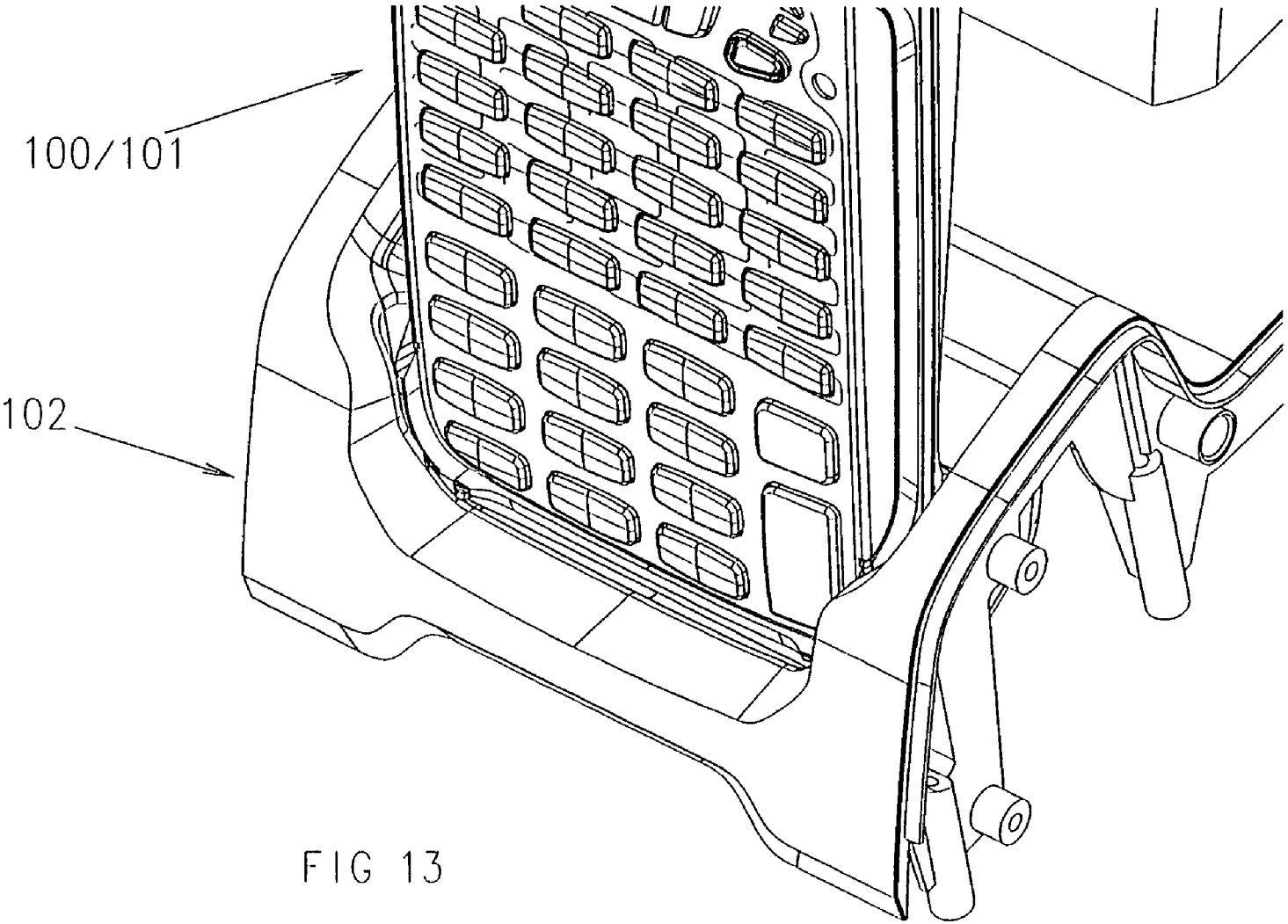
FIG. 13 is an illustration the mobile computing device of FIG. 12 being slidably held in a cradle that has a connector mounted therein using the holder of the current invention.
Figure 14:
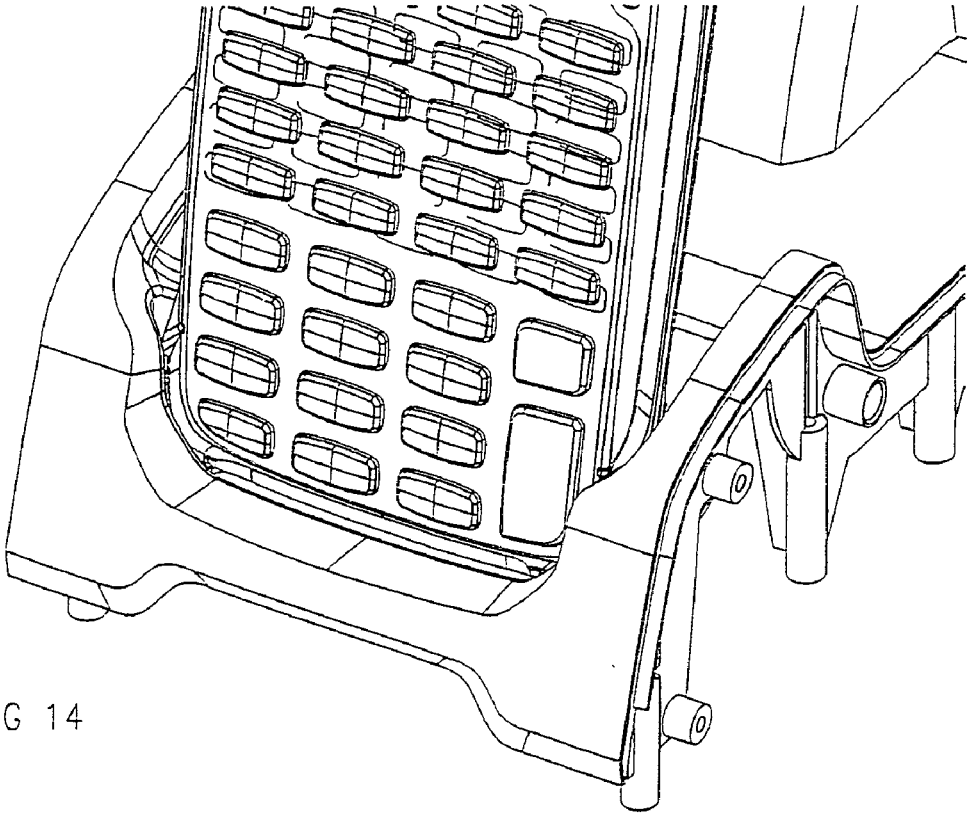
FIG. 14 is an illustration of a cradle with a rubber bumper that may provide a cushion and clearance for slidably reception of the mobile computing device within the cradle, without stressing a connector.
Figure 15:
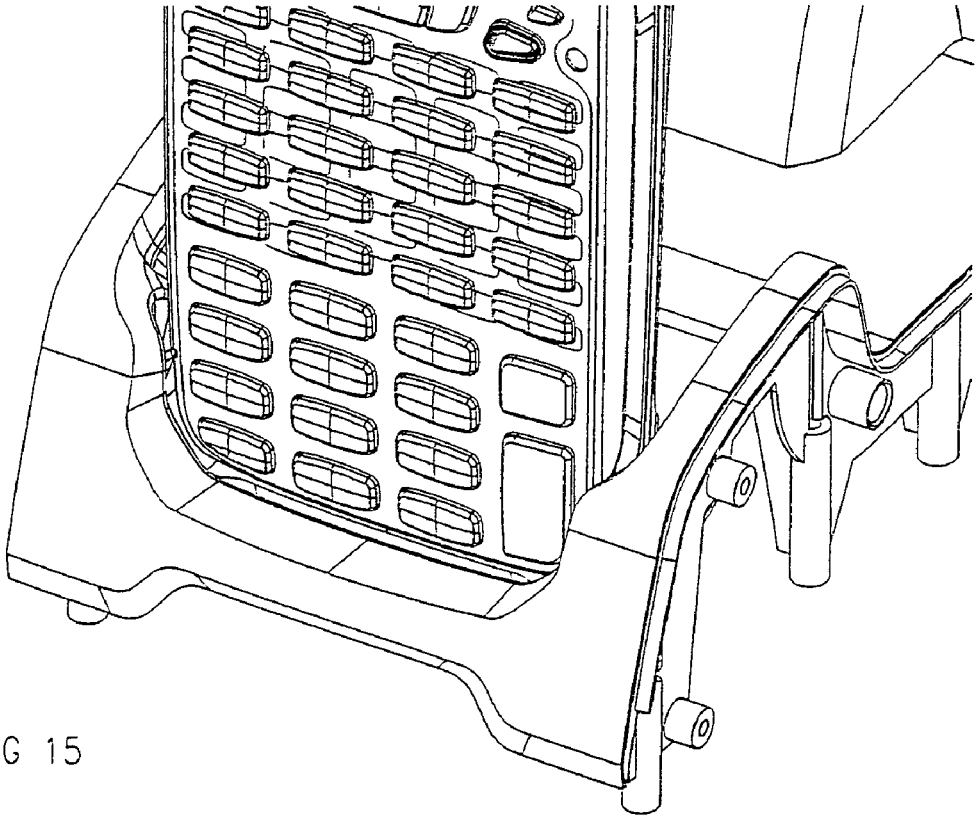
FIG. 15 is an illustration of the cradle of FIG. 14 where the rubber bumper has been deformed so as to eliminate all clearance between the terminal and the cradle, which may deflect a mating connector.

FIG. 2 illustrates one embodiment of the holder 20 of the present invention, which is a uniquely formed bracket capable of providing releasable support for connector 11, and flexible mounting of the connector 11 within, and relative to, a cradle 102. FIG. 12 shows a pair of gun-shaped mobile computing devices, 100 and 101, which are shown merely to be illustrative of one type of application for which the holder or bracket of the present invention may be beneficial. FIG. 13 illustrates one of the mobile computing devices 100/101 being held in a cradle 102, where a connector 101A (general location shown in FIG. 12) in the mobile computing device 100 may be slidably received by the connector held by the holder 20 of the current invention that may be mounted to the cradle 102.

The holder 20 may be manufactured of any suitable material for a particular application, and thus may be metallic, plastic, or even wood. Holder 20 may be manufactured as a single part, as shown in FIG. 2, or may be formed from an assembly of two or more parts. The complex shape of the single part shown in FIG. 2 may best be formed as an injection molded part, but could also be a sheet metal part with multiple bends.

The first embodiment of the holder 20 of the present invention may have a receptacle 21 for providing direct support for the electrical connection H. The receptacle 21 may be formed using a rear wall 22, which is generally flat. Extending outward from the rear wall 22 may be a first side wall 23 and a second side wall 24. The first and second sidewalls 23 and 24 may generally be parallel to each other and be orthogonal to the rear wall 22. The combination of first and second side walls 23 and 24 and rear wall 22 may serve to create a three-sided enclosure into which the electrical connector may be releasably retained. The first and second side walls 23 and 24, and rear wall 22 may work in combination with other features to support and retain the connector 11 in the receptacle 21, including, but not limited to, incorporating flexible protrusions or using a cover plate.

Flexible protrusions 25 may protrude out from the first side wall 23 and second side wall 24 to be snapped into, or retained by, a groove or recess in the connector 11, and maintain the connector in close proximity to the rear wall 22, and generally centered between first and second side walls 23 and 24. The height of the protrusions may depend upon the connector supported or upon the material utilized. Even where the holder 20 is formed from metal or plastic, the protrusions 25 may be formed from that same material, but more preferably may be formed of a rubberized material.

Support for the cover may also be provided by a cover 15. The first and second side walls 23 and 24 may each have a mounting flange 26 and 27, where the flanges 26 and 27 are generally orthogonal to the first and second side walls. The mounting flanges 26 and 27 may each have one or more orifices 28 that are capable of receiving a fastener (not shown) to mount the cover 15. A nut and bolt arrangement (not shown) may be utilized to install the cover, or alternatively, the orifices 28 may be internally threaded so the cover can be mounted with only the use of a bolt.

The cover 15 may engage a recess on one side of the connector 11, while the rear wall may have a lip (not shown) that similarly engages a recess on the other side of the connector. The engagement by the cover and the lip may be set to provide clearance so as not to clamp-up upon the connector 11, and potentially cause damage. The portion of the cover 15 that engages the connector 11, and the lip on the rear wall 22 may thus be preferably made of a rubberized material. Also, to provide a rigid receptacle that may protect the connector 11, the first side wall 23 and the mounting flange 26, as well as the second side wall 24 and the mounting flange 27 may have stiffening walls 29 and 30, respectively.

Mounting of the connector 11 in the receptacle 21 will result in flexible support by way of the configuration of the remainder of the holder 20. The configuration of holder 20 further comprises rear wall 22 extending for a certain length to join a connecting wall 32. Rear wall 22 and connecting wall 32 may be joined by a radiused bend 33. The radiused bend 33 may preferably be a generous radius to promote flexure between the rear wall 22 and the connecting wall 32.

Figure 3:
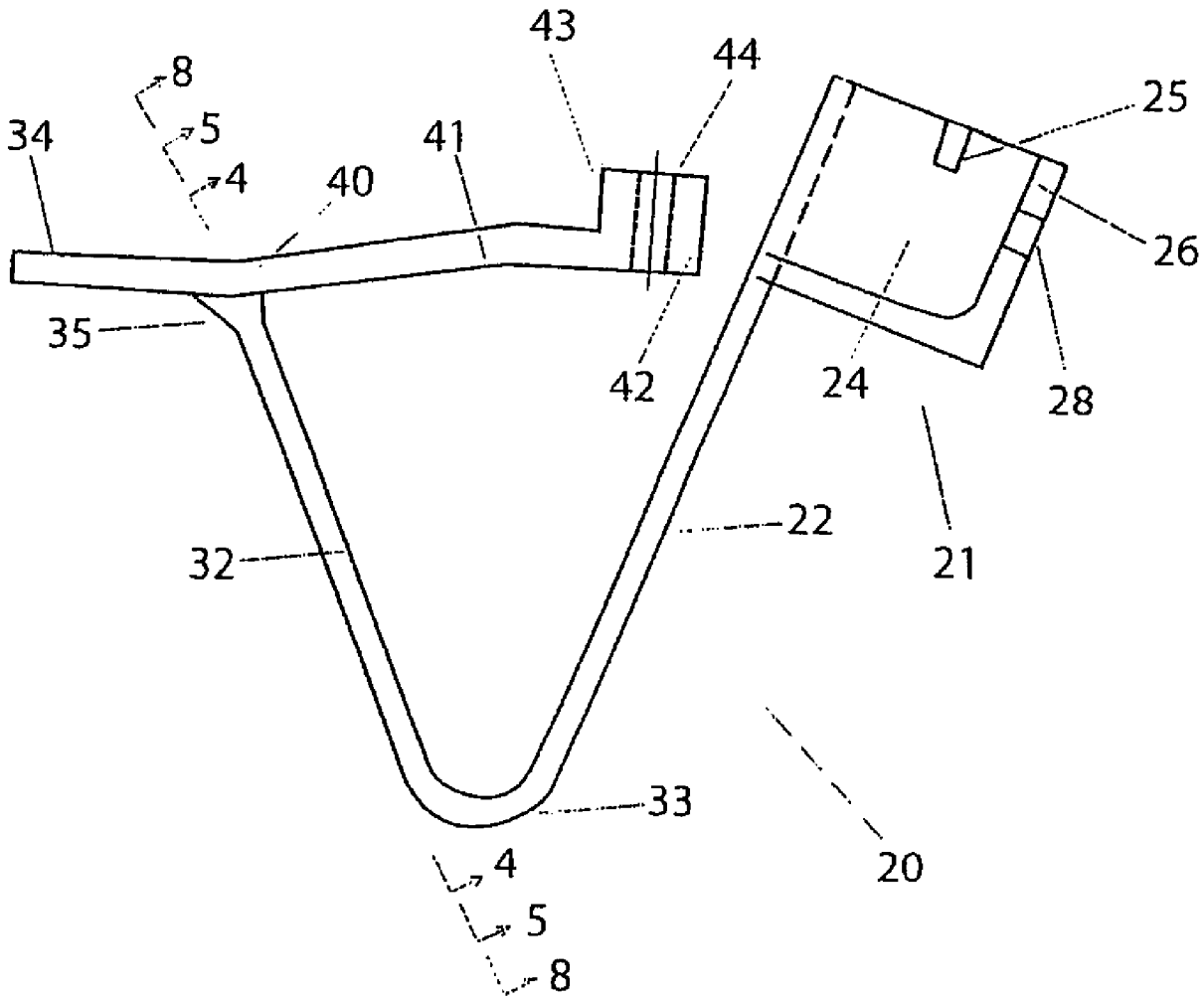
FIG. 3 is a side view of the first embodiment of the current invention.

The connecting wall 32 may also be of a certain length before it transitions into a transverse wall 34. Connecting wall 32 may transition into transverse wall 34 using a radiused bend 35. The radiused bend 35 may preferably also be a generous radius to promote flexure. Transverse wall 34 may preferably have a first end 36 and a second end 37 extending beyond the ends of connecting wall 32. Extending from the first end 36 and second end 37 may be cantilevered straps 39 and 45, respectively, which may protrude generally orthogonally away from the transverse wall 34 and back towards the receptacle 21, as seen in FIGS. 2 and 3. There is preferably a gap 38 between the radiused bend 35 and each of the straps 39 and 45, in order to improve rotational flexure as described hereinafter.

The strap 39 may preferably have a joggled step that is formed by a first bend 40 and a second bend 41, so that the free end of strap 39 is offset from the transverse wall 34 and may be generally parallel to the transverse wall 34. The strap 39 may terminate in the free end 42 which may be rounded, and which may have a boss 43 protruding upward therefrom. The boss 43 may have an orifice 44, which may be used for the mounting of holder 20. Strap 45 may be similarly be formed with a first bend 46, and second bend 47, and having a free end 48 with upward protruding boss 49 that has an orifice 50. However, rather than utilizing an orifice in each of the straps 39 and 45, the holder may be mounted through a welding process or some other means of mechanically clamping the holder to a mounting surface.

Figure 17:
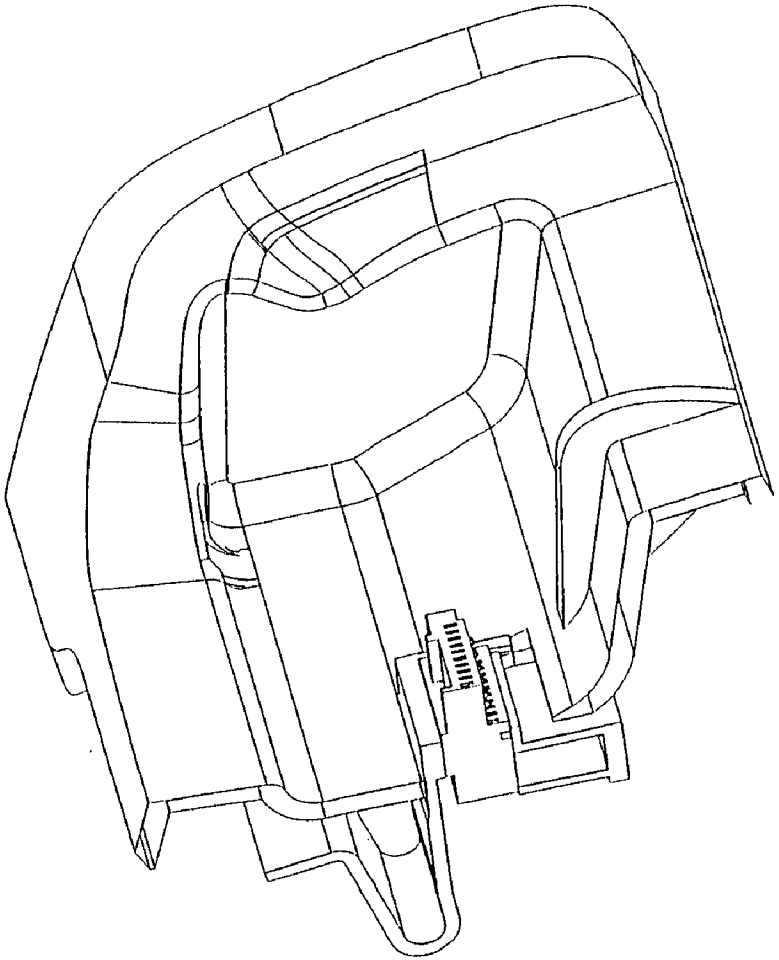
FIG. 17 shows a section view of the holder of FIG. 16 where the connector and holder have been deflected to eliminate the gap.
Figure 16:
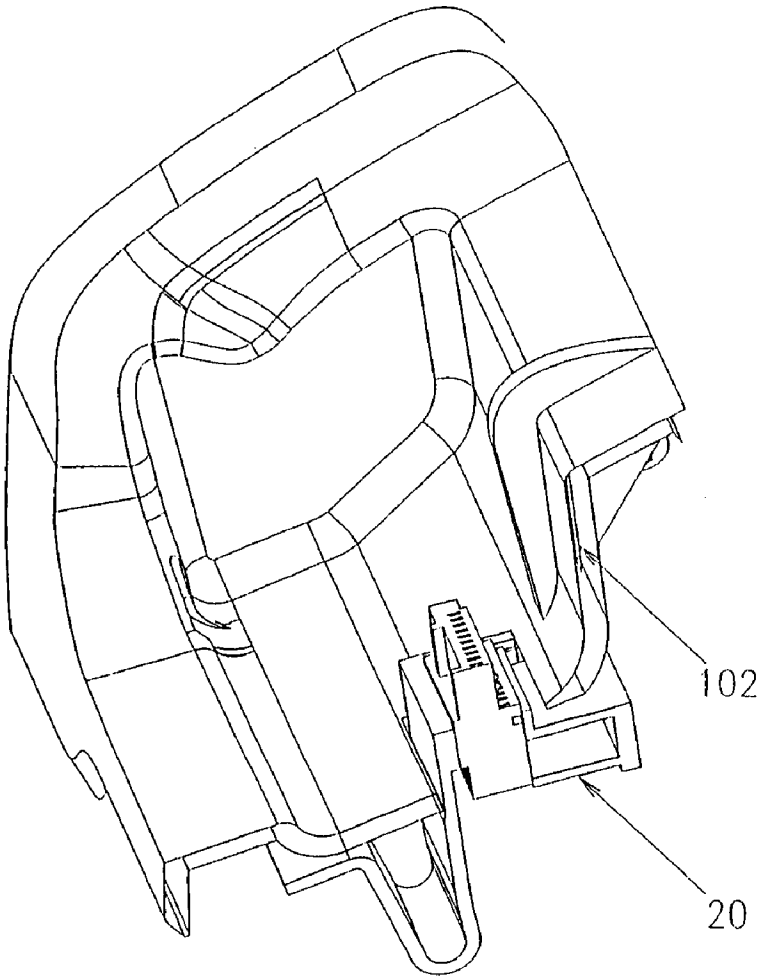
FIG. 16 shows a section view of the holder of the present invention mounted to a cradle and supporting a connector therein with a gap between the connector and cradle.
Figure 18:
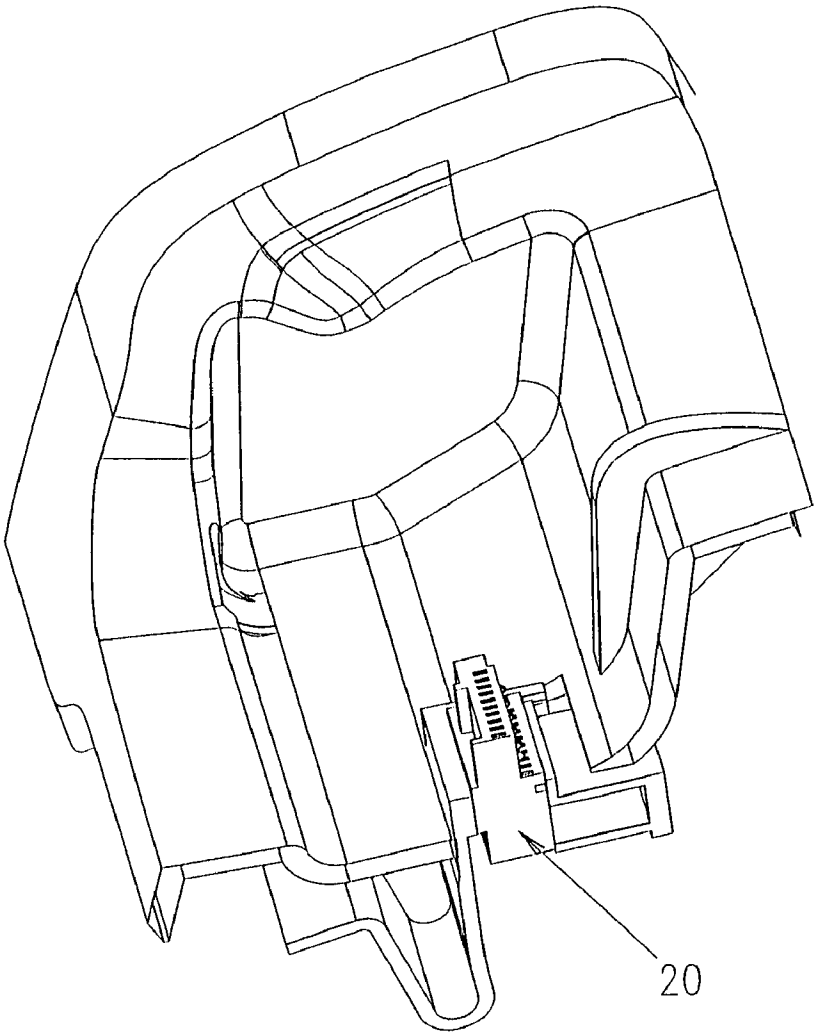
FIG. 18 shows a connector mounted to a cradle using the holder of the present invention, with the connector protruding up from the cradle.
Figure 19:
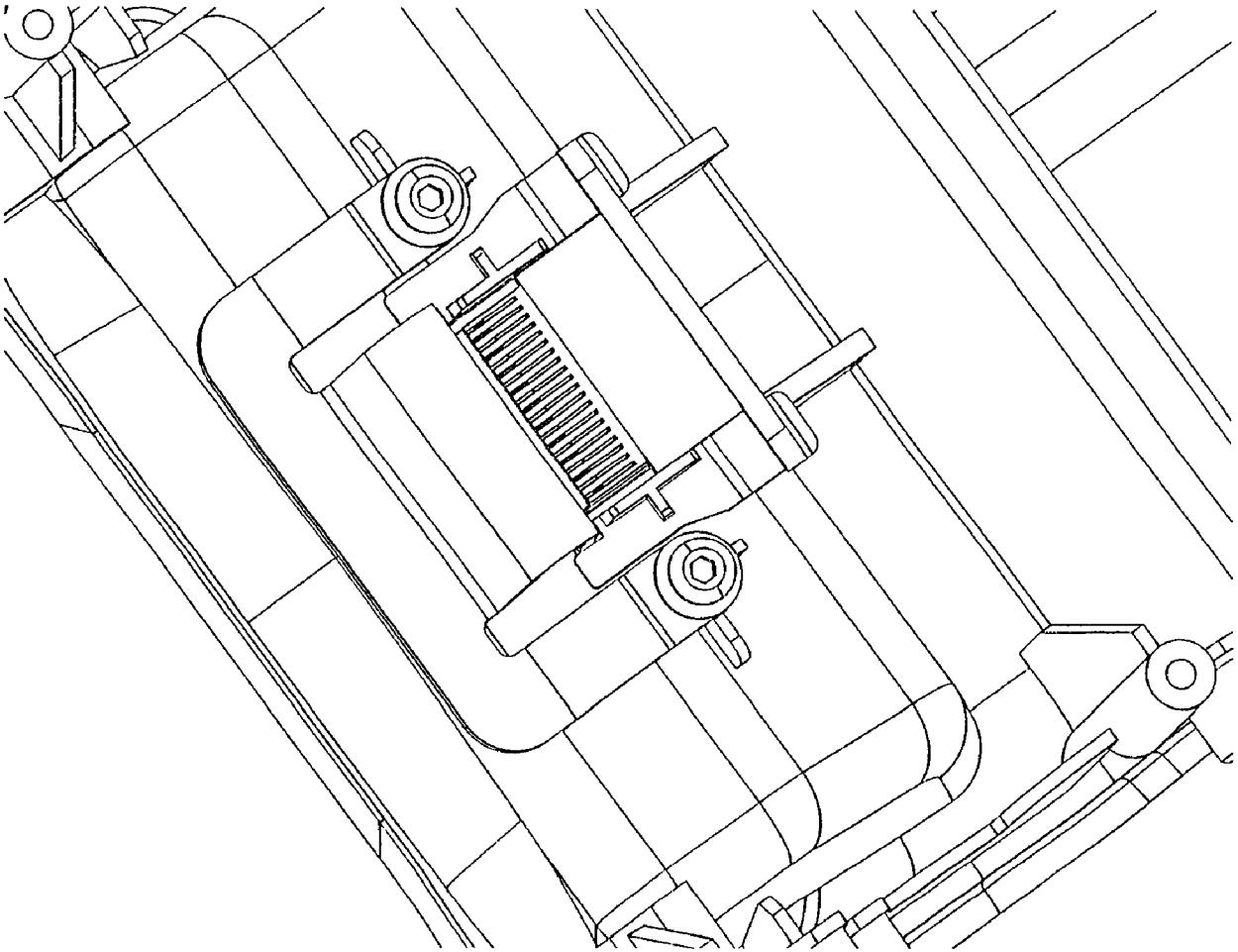
FIG. 19 shows a perspective view of the bottom of a cradle with the holder of the present invention mounted to the cradle.
Figure 20:
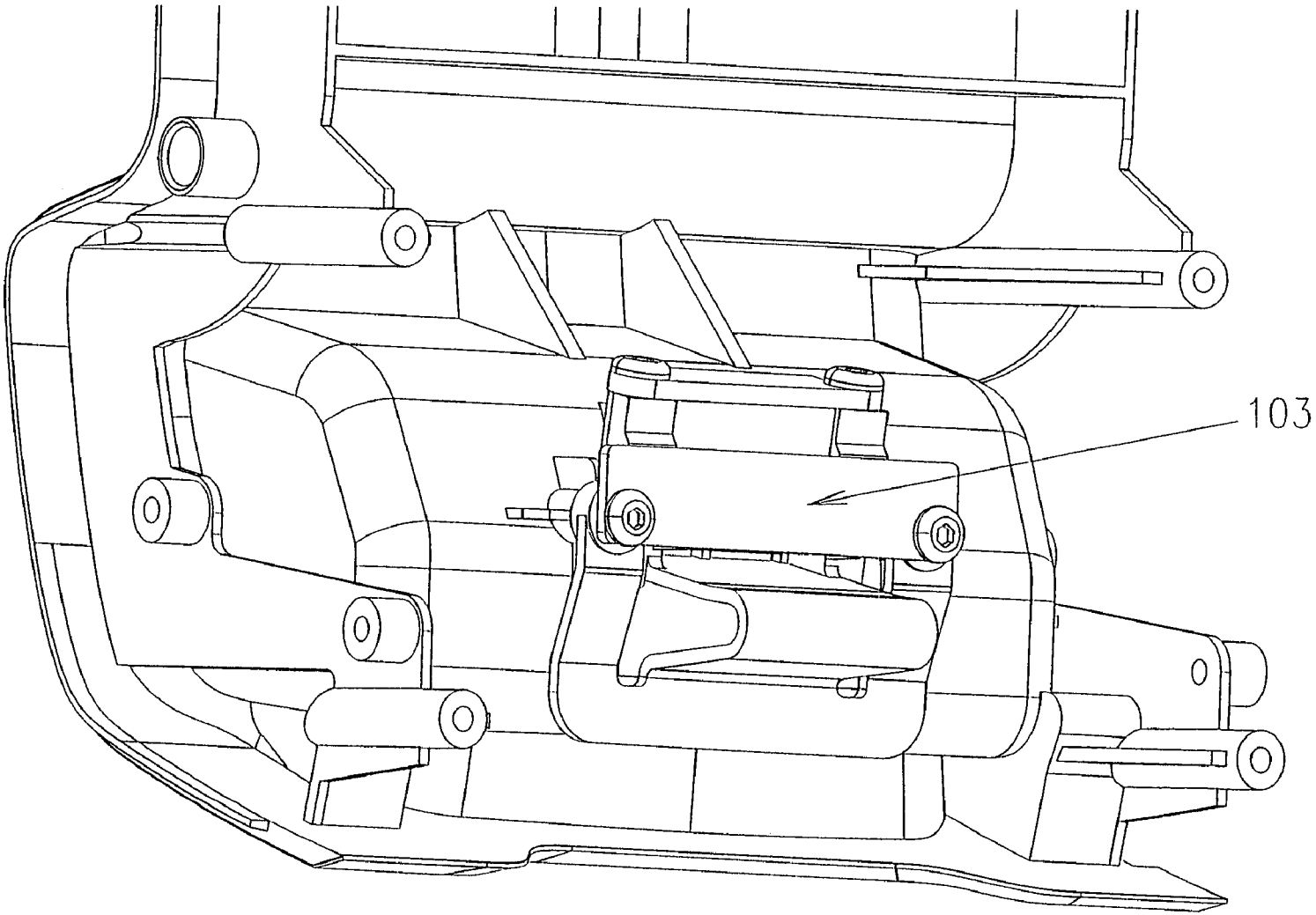
FIG. 20 shows a perspective view of the bottom of a cradle with the holder of the present invention mounted to the cradle, and with a Z-bracket mounted therein to limit travel of the holder of the present invention.

As seen in FIGS. 16 and 17, a connector 11 may be retained within the holder 20, and the holder 20 may be mounted to a cradle 102 of a charging device or other kind of device. The opening in the cradle 102 is preferably oversized at least 2 mm larger that the connector 20 to permit deflection of the connector 11 relative to the cradle 102. To prevent excessive deflection of the bracket, a travel-limiting bracket 103 may also be attached in conjunction with the holder 20 attachment to the cradle (FIG. 20) to inhibit excessive deflections of the holder 20.

Figures 4, 5, 6, 7, 8, 9:
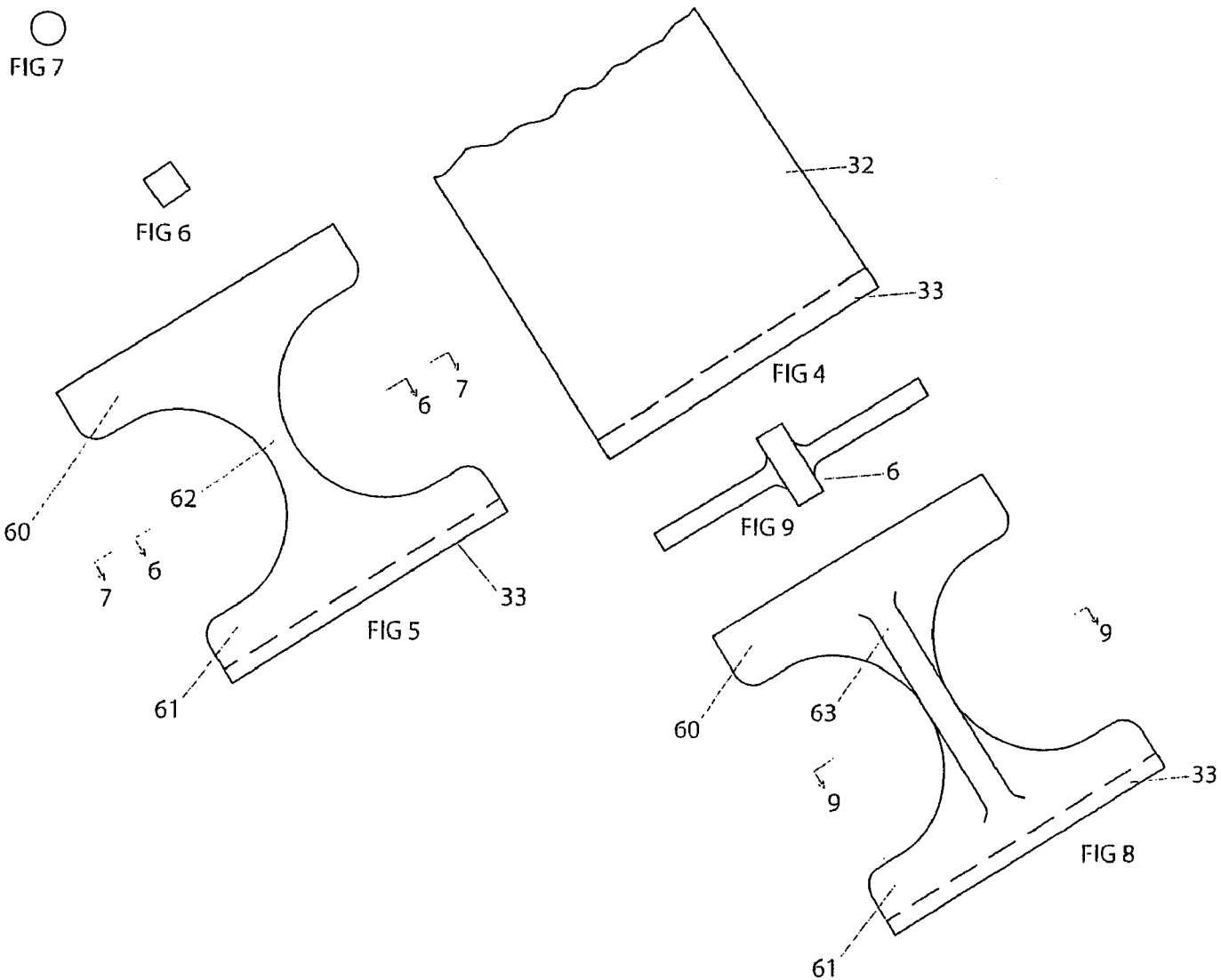
FIG. 4 is an auxiliary view of the connecting wall of the first embodiment of the current invention, having the full rectangular width for the entire connecting wall.
FIG. 5 is an auxiliary view of the connecting wall of a second embodiment of the current invention, having the rectangular width of the connecting wall neck down.
FIG. 6 is a section cut through the necked down area of the connecting wall of the second embodiment, with the necked down area having a square cross-section.
FIG. 7 is a section cut through the necked down area of the connecting wall of a third embodiment in which the necked down area has a round cross-section.
FIG. 8 is an auxiliary view of the connecting wall of a fourth embodiment of the current invention, having the rectangular width of the connecting wall neck down, but also having a rectangular-stiffened cross-section.
FIG. 9 is a section cut through the necked down area of the connecting wall of the fourth embodiment.

In an alternate embodiment, the generally flat and rectangular connecting wall 32, as seen in perspective view in FIG. 2 and in the true view in FIG. 4, may neck down (FIG. 5). The connecting wall would then consist of a first generally rectangular region 60 and a second generally rectangular region 61 that are separated by a neck 63. The neck area 63 may simply have a square cross-section as seen in FIG. 6, or in a third embodiment, it may be tailored to have a circular cross-section, as seen in FIG. 7, which may gradually transition into the planar rectangular regions 60 and 61. The square cross-section could be grown in the plane of the wall to be rectangular, and therefore be more resistant to fatigue failure, but such increases would tend to decrease rotational flexure as herein discussed.

In a fourth embodiment, the neck 63 may have a stiffener 64 with a rectangular cross-section that is generally transverse or orthogonal to the plane of the connecting wall. Stiffener 64 may preferably extend onto a least a portion of the planar rectangular regions 60 and 61. The thickness for the stiffener 64, as well as each of the walls utilized, may be tailored to provide for flexure for specific installation requirements, and according to the material used in manufacturing the holder. The stiffness, and thus flexure, may also be changed by changing the lengths of certain members.

Figure 10:
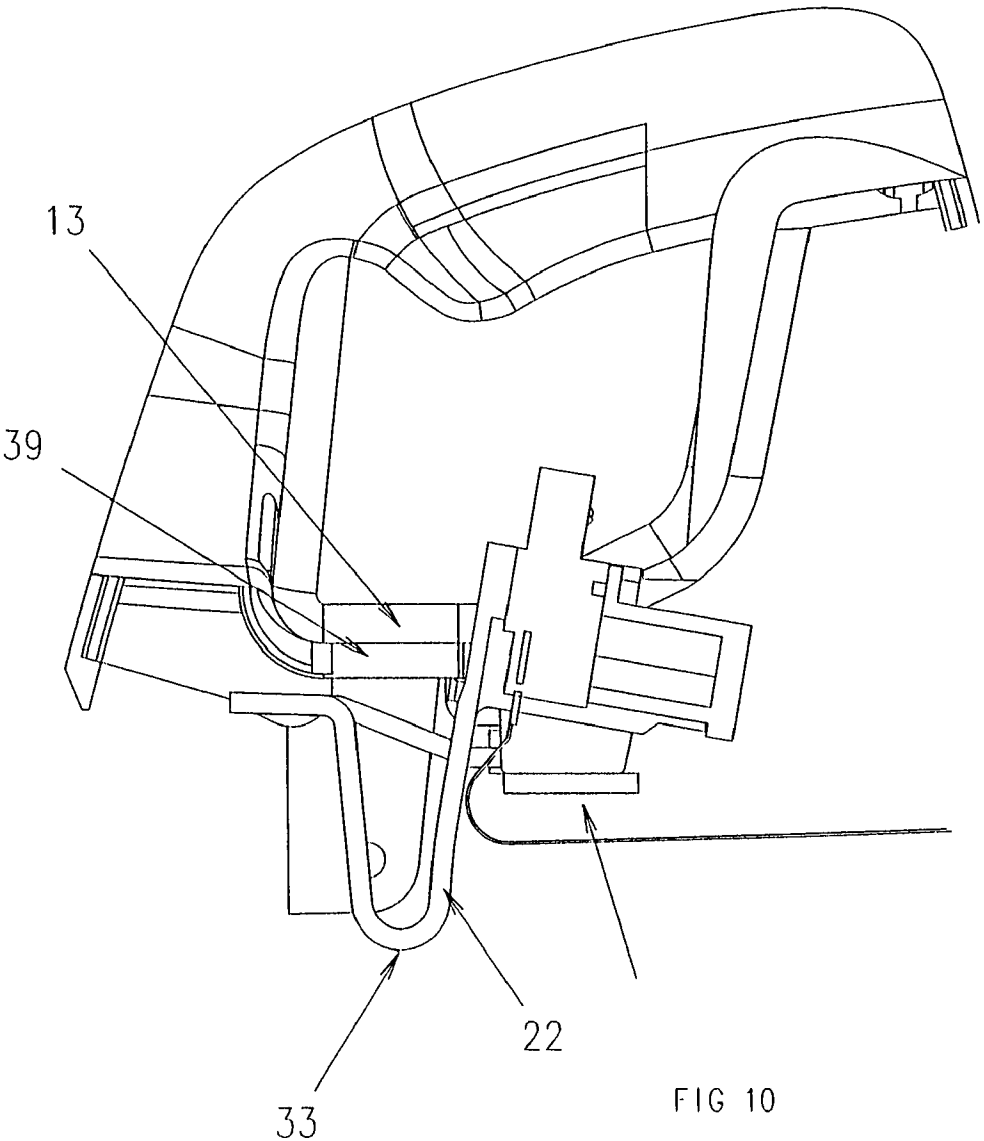
FIG. 10 is the first embodiment of the current invention shown installed with a Z-support bracket to provide back-up hard stops for excessive deflection.
Figure 11:
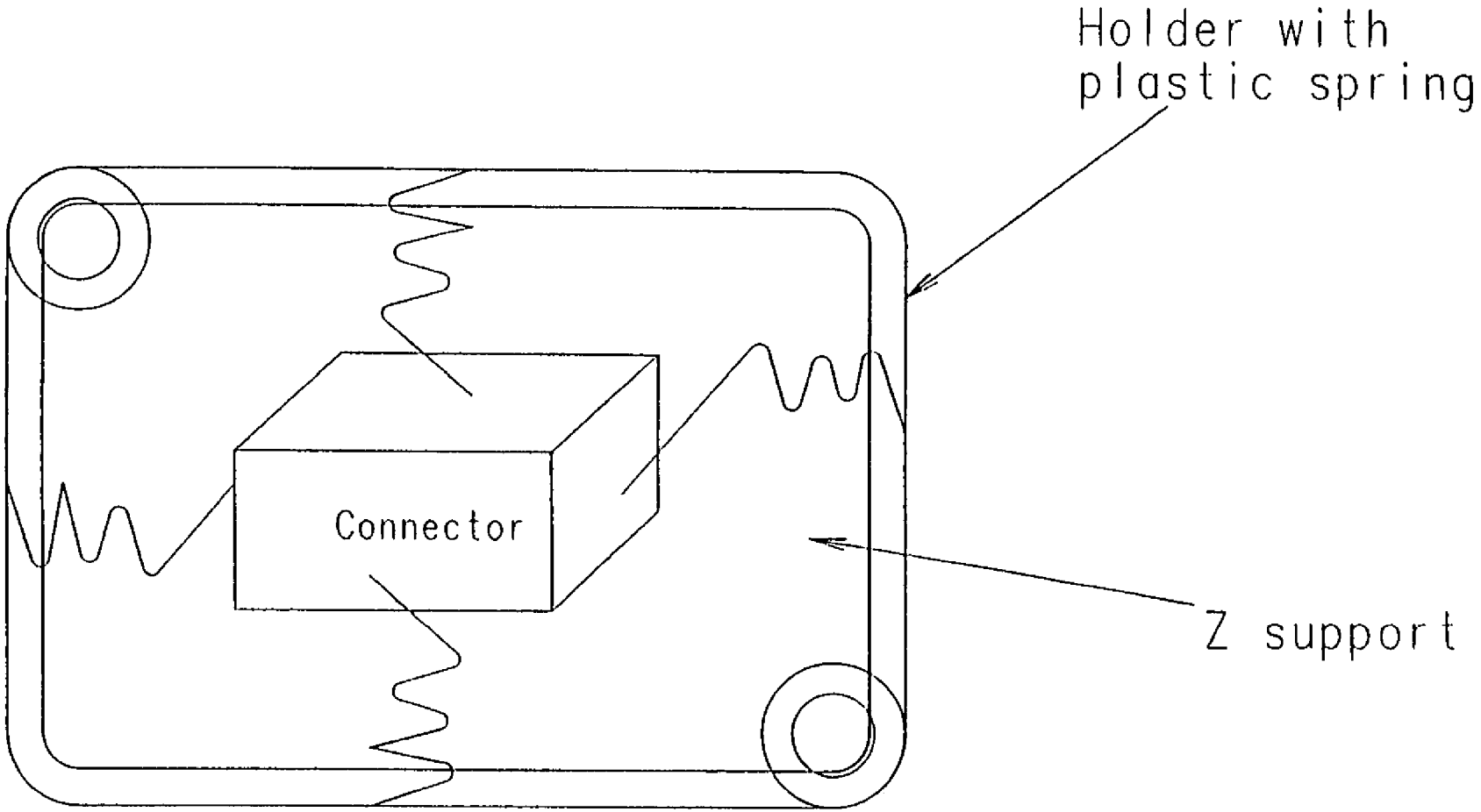
FIG. 11 is a schematic representation of the flexible dynamic response afforded the flexible printed circuit connector when mounted in the first embodiment of the current invention.

It can be seen that mounting of the holder 20, with a connector releasably retained by the receptacle 21, using screws or bolts etc. through orifices 44 in the bosses 43 and 49 to attach the holder, produces a very flexible supporting arrangement. The arrangement is capable of accommodating multiple degrees of motion with loads applied upon the connector, to reduce stresses and yielding of the connector, and lessen the potential for damage to one or more terminals. The flexure which may be accommodated by holder 20 may be translation in the X, the Y, and/or the Z direction (see the axes depicted on FIG. 2), and well as rotational movement about each of those axes or some combination. As stated previously, the amount of flexure that may be safely accommodated may depend on specifics of each design, however, as shown in FIGS. 2 and 10, the holder 20 may be capable of supporting translations or more than 0.5 inches along each of the axes.

Rotation about the X axis may be seen to be accommodated by the cantilevered straps 39 and 45 working in conjunction with the bosses 43 and 49. A rotational force applied to the connector 11 may be accommodated by the strap 39 deflecting upward towards the mounting surface 13 (FIG. 10), the clearance for which is provided by the offset achieved with to the height of boss 43, while the strap 45 may deflect downwards, and wherein the transverse wall may be angled relative to its rest position. Counter-rotation about the X axis may similarly be accommodated by downward deflection of the strap 39 and upward deflection of strap 45.

Rotation about the Y axis may be seen to be accommodated by the flexure of the rear wall 22 relative to the connecting wall 32, and flexure of the connecting wall 32 relative to the transverse wall 34. In this respect, the affect of material thicknesses utilized and the lengths of the wall members may have more of a pronounced effect upon the capability of the holder to support increasing Y-rotational movements, as compared with rotation about the other axes. However, rotation movement about the Y axis is also accommodated by simultaneous deflection of the straps 39 and 45, in either the upward or downward direction. Also, a significant gap 38 between the radiused bend 35 and each of the straps 39 and 45 would promote greater rotational flexure by further permitting torsional defection of the transverse wall 34 relative to the straps 39 and 45.

Rotation about the Z axis may be seen to be accommodated by the flexure of the connecting wall 32, particularly where it transitions to have a neck 62 separating two generally rectangular regions 60 and 61, as seen in FIG. 5. The necked down arrangement of FIG. 5, while providing much flexural capability, may be prone to fatiguing and breakage. Therefore, the neck 62 may have a stiffener 63, which would not greatly inhibit flexural capability about the Z axis.

While the deflections which may be accommodated by the holder 20 may be quite large, they may ultimately be excessive in relation to other aspects of the overall design of the unit. In such cases, fixed stops may be incorporated into the unit itself, or alternatively be added to the holder 20. The unit may also, as described previously, be designed to reduce flexural capability and potential deflections by increasing thicknesses and reducing member lengths.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

The invention claimed is:

1. A bracket comprising:

(a) a receptacle, for use in providing releasable support for an electrical connector, said receptacle comprising a back wall with one or more support walls extending from at least a portion of said back wall;

(b) a connecting wall, said back wall flexibly transitioning into said connecting wall;

(c) a transverse wall, said connecting wall flexibly transitioning into at least a portion of said transverse wall;

(d) a first strap and a second strap; said first and second straps extending from said transverse wall respectively at a positions being adjacent to a first side and a second side of said connecting wall, said first and second straps extending generally in a direction towards said receptacle and terminating at a free end; and (e) an orifice in said free end of each of said first and second straps, said orifices permitting cantilevered mounting of said bracket with said receptacle thereby being capable of flexibly accommodating multiple degrees of motion imposed thereon.

2. The bracket according to claim 1, wherein said free end of said first and second straps each further comprises a boss protruding upward, said orifice of said first and second straps being generally centered within said boss of said first and second straps.

3. The bracket according to claim 2, wherein said one or more support walls comprises generally parallel first and second sidewalls extending from said at least a portion of said back wall.

4. The bracket according to claim 3, wherein said back wall flexibly transitions into said connecting wall using a radiused bend.

5. The bracket according to claim 4, wherein said connecting wall flexibly transitions into said at least a portion of said transverse wall using a radiused bend.

6. The bracket according to claim 5, wherein each of said first and second straps comprise a first bend and a second bend.

7. The bracket according to claim 6, wherein said back wall is generally flat.

8. The bracket according to claim 7, wherein said receptacle provides for slidable connector-mounting.

9. The bracket according to claim 8, wherein said first and second walls further comprise one or more protrusions, said one or more protrusions providing for releasable connector retention.

10. The bracket according to claim 8, wherein each of said first and second walls further comprise a mounting flange.

11. The bracket according to claim 10, wherein each of said mounting flanges has an orifice.

12. The bracket according to claim 11, wherein said orifices receive a fastener for mounting of a cover.

13. The bracket according to claim 12, wherein said cover provides for releasable connector retention.

14. The bracket according to claim 13, wherein said orifices are internally threaded and said fastener is a bolt.

15. The bracket according to claim 14, wherein said multiple degrees of motion comprises translation along a first axis.

16. The bracket according to claim 15, wherein said multiple degrees of motion further comprises translation along a second axis, said second axis being orthogonal to said first axis.

17. The bracket according to claim 16, wherein said multiple degrees of motion further comprises translation along a third axis, said third axis being orthogonal to said first axis and orthogonal to said second axis.

18. The bracket according to claim 17, wherein said translation is greater than 0.5 inches along each of said first, said second, and said third axes.

19. The bracket according to claim 18 wherein said multiple degrees of motion comprises rotational movement about one or more of said first, said second, and said third axes.

20. The bracket according to claim 19, wherein said connecting wall is generally rectangular.

21. The bracket according to claim 19, wherein said connecting wall comprises a first rectangular region, and a second rectangular region, said first rectangular region and said second rectangular region being separated by an elongated neck area.

22. The bracket according to claim 21, wherein said elongated neck area has a circular cross-section, said circular cross-section of said neck serving as a transition between said first rectangular part and said second rectangular part.

23. The bracket according to claim 21, wherein said elongated neck area has a square cross-section.

24. The bracket according to claim 21, wherein said elongated neck area is formed to have a stiffener with a rectangular cross-section, said rectangular cross-section being approximately orthogonal to said first region and said second region.

25. The bracket according to claim 24, wherein at least a portion of said rectangular cross-section of said stiffener extends upon at least a portion of said first rectangular part and said second rectangular part of said connecting wall.

26. A bracket, for use in the flexible mounting of electrical connectors of flexible printed circuits, said bracket comprising:

(a) a receptacle, said receptacle comprising at least a back wall and first and second side walls, said first and second side walls extending from at least a portion of said back wall; said receptacle being capable of providing releasable support for an electrical connector;

(b) a connecting wall, said back wall flexibly transitioning into said connecting wall;

(c) a transverse wall, said connecting wall flexibly transitioning into at least a portion of said transverse wall;

(d) a first strap and a second strap; said first and second straps extending from said transverse wall respectively at positions being adjacent to a first side and a second side of said connecting wall, said first and second straps extending generally in a direction towards said receptacle and terminating at a free end; and (e) an orifice in said free end of each of said first and second straps, said orifices providing for cantilevered mounting of said bracket with said receptacle thereby being capable of flexibly accommodating multiple degrees of motion relative to said bracket mounting orifices.

27. The bracket according to claim 26, wherein said free end of said first and second straps each further comprises a boss protruding upward, said orifice of said first and second straps being generally centered within said boss of said first and second straps.

28. The bracket according to claim 26, wherein said back wall flexibly transitions into said connecting wall using a radiused bend.

29. The bracket according to claim 26, wherein said connecting wall flexibly transitions into said at least a portion of said transverse wall using a radiused bend.

30. The bracket according to claim 26, wherein each of said first and second straps have a first bend and a second bend.

31. The bracket according to claim 26, wherein said back wall is generally flat.

32. The bracket according to claim 26, wherein said releasable support for an electrical connector permits slidable connector-mounting.

33. The bracket according to claim 26, wherein said first and second walls further comprise one or more protrusions, said one or more protrusions providing for releasable connector retention.

34. The bracket according to claim 33, wherein each of said first and second walls further comprise a mounting flange.

35. The bracket according to claim 34, wherein each of said mounting flanges has an orifice.

36. The bracket according to claim 35, wherein said orifices receive a fastener for mounting of a cover.

37. The bracket according to claim 36, wherein said cover provides for releasable connector retention.

38. The bracket according to claim 37, wherein said orifices are internally threaded and said fastener is a bolt.

39. The bracket according to claim 26, wherein said multiple degrees of motion comprises translation along a first axis.

40. The bracket according to claim 26, wherein said multiple degrees of motion comprises translation along a first and a second axis, said second axis being orthogonal to said first axis.

41. The bracket according to claim 26, wherein said multiple degrees of motion comprises translation along a first axis, a second axis, and a third axis, said second axis being orthogonal to said first axis, and said third axis being orthogonal to both said first axis and said second axis.

42. The bracket according to claim 41, wherein said bracket is capable of accommodating motion comprising translation of at least 0.5 inches along each of said first, said second, and said third axes.

43. The bracket according to claim 42 wherein said multiple degrees of motion comprises rotational movement about one or more of said first, said second, and said third axes.

44. The bracket according to claim 26, wherein said connecting wall is generally rectangular.

45. The bracket according to claim 26, wherein said connecting wall comprises a first rectangular portion, and a second rectangular portion, said first rectangular portion and said second rectangular portion being connected by an elongated neck portion.

46. The bracket according to claim 45, wherein said elongated neck portion comprises a circular cross-section, said circular cross-section of said neck providing flexibility between said first rectangular portion and said second rectangular portion.

47. The bracket according to claim 45, wherein said elongated neck portion comprises a rectangular cross-section, said rectangular cross-section of said neck providing flexibility between said first rectangular portion and said second rectangular portion.

48. The bracket according to claim 47, wherein said elongated neck portion further comprises a stiffener with a rectangular cross-section, said rectangular stiffener being generally orthogonal to said first rectangular portion and said second rectangular portion.

49. The bracket according to claim 48, wherein at least a portion of said rectangular cross-section of said stiffener extends upon at least a portion of said first rectangular part and said second rectangular part of said connecting wall.

50. A bracket, for use in flexible mounting of the electrical connector of a flexible printed circuit, said bracket comprising:

a receptacle, said receptacle comprising a means of releasably supporting the electrical connector;

a first wall, said receptacle being supported proximate to a first end of said first wall;

a second wall, a first end of said second wall being flexible connected to a second end of said first wall;

a third wall, a portion of a first end of said third wall being flexible connected to a second end of said second wall; and a first strap and a second strap, said first and second straps each having a first end flexibly connected to and extending away from said first end of said third wall towards said receptacle, a second end of each of said first and second straps comprising an orifice to permit mounting of said bracket, said flexible connections between said first, second, and third walls accommodating multiple degrees of motion imparted to said receptacle.

* * * * *